US006528226B1

(12) United States Patent
Yu et al.

(10) Patent No.: US 6,528,226 B1
(45) Date of Patent: Mar. 4, 2003

(54) ENHANCING ADHESION OF ORGANIC ELECTROSTATOGRAPHIC IMAGING MEMBER OVERCOAT AND ANTICURL BACKING LAYERS

(75) Inventors: Robert C. U. Yu, Webster, NY (US); Satchidanand Mishra, Webster, NY (US); Philip G. Perry, Webster, NY (US); Robert W. Nolley, deceased, late of Rochester, NY (US), by Vivian D. Nolley, legal heir; Gene W. O'Dell, Williamson, NY (US); Merlin E. Scharfe, Penfield, NY (US); John M. Magde, Jr., Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/722,577

(22) Filed: Nov. 28, 2000

(51) Int. Cl.[7] ..... G03G 5/00

(52) U.S. Cl. ..... 430/132; 430/130; 430/127; 430/133; 427/536

(58) Field of Search ..... 430/130, 132, 430/133, 127; 427/536

(56) References Cited

U.S. PATENT DOCUMENTS

| | | | | | |
|---|---|---|---|---|---|
| 3,121,006 | A | | 2/1964 | Middleton et al. | |
| 3,357,989 | A | | 12/1967 | Byrne et al. | |
| 3,442,781 | A | | 5/1969 | Weinberger | |
| 4,286,033 | A | | 8/1981 | Neyhart et al. | |
| 4,291,110 | A | | 9/1981 | Lee | |
| 4,338,387 | A | | 7/1982 | Hewitt | |
| 4,415,639 | A | | 11/1983 | Horgan | |
| 4,508,804 | A | * | 4/1985 | Asao et al. | 430/62 |
| 4,588,666 | A | | 5/1986 | Stolka et al . | |
| 4,666,735 | A | | 5/1987 | Hoover et al. | |
| 4,871,634 | A | | 10/1989 | Limburg et al. | |
| 4,882,256 | A | * | 11/1989 | Osawa et al. | 430/132 |
| 5,013,624 | A | | 5/1991 | Yu | |
| 5,457,523 | A | * | 10/1995 | Facci et al. | 399/168 |
| 5,514,507 | A | | 5/1996 | Yagi et al. | |
| 5,521,047 | A | | 5/1996 | Yuh et al. | |
| 5,635,327 | A | | 6/1997 | Fukuda et al. | |
| 5,709,974 | A | | 1/1998 | Yuh et al. | |
| 5,891,594 | A | | 4/1999 | Yuh et al. | |
| 5,915,514 | A | | 6/1999 | Nojiri et al. | |
| 6,045,962 | A | * | 4/2000 | Kushibiki et al. | 430/132 |
| 6,071,662 | A | * | 6/2000 | Carmichael et al. | 430/69 |
| 6,099,996 | A | * | 8/2000 | Yanus et al. | 430/133 |
| 6,180,309 | B1 | * | 1/2001 | Maty et al. | 430/130 |

FOREIGN PATENT DOCUMENTS

| | | | |
|---|---|---|---|
| JP | 56043638 A | * | 4/1981 |
| JP | 0540355 A | * | 2/1993 |
| JP | 08062876 A | * | 3/1996 |
| JP | 10254157 A | * | 9/1998 |

OTHER PUBLICATIONS

Schaffert, R. M. Electrophotography. New York: John Wiley & Sons. (1975) pp. 441–443, 472, 473.*

Schaffert, R. M. Electrophotography. New York: John Wiley & Sons. (1975) pp. 472–473.*

* cited by examiner

*Primary Examiner*—Christopher Rodee
(74) *Attorney, Agent, or Firm*—Oliff & Berridge, PLC

(57) ABSTRACT

A process for preparing an imaging member includes applying an organic layer to an imaging member substrate, treating the organic layer and/or a backside of the substrate with a corona discharge effluent, and applying an overcoating layer to the organic layer and/or an anticurl backing layer to the backside of the substrate.

26 Claims, 1 Drawing Sheet

ENHANCING ADHESION OF ORGANIC ELECTROSTATOGRAPHIC IMAGING MEMBER OVERCOAT AND ANTICURL BACKING LAYERS

BACKGROUND OF THE INVENTION

1. Field of Invention

This invention relates in general to an electrostatographic imaging member, and in particular, to a process for preparing electrostatographic imaging members and to imaging members produced thereby. In particular, the invention provides a process for enhancing the adhesion of an overcoat layer to the top outermost organic layer of an organic electrostatographic imaging member. Since organic electrostatographic imaging members in a flexible belt configuration require an anticurl backing layer to ensure that the imaging member belt is sufficiently flat, the process of the present invention can also provide improved adhesive bond strength between an anticurl backing layer and a substrate support layer.

2. Description of Related Art

Electrostatographic imaging members are well known in the art. Typical electrostatographic imaging members include, for example, (1) photosensitive members (photoreceptors) commonly used in electrophotographic (xerographic) imaging processes and (2) electroreceptors such as ionographic imaging members for electrographic imaging systems. An electrostatographic imaging member can be in a rigid drum configuration or in a flexible belt configuration, that can be either a seamless or a seamed belt. Typical electrophotographic imaging member drums comprise a charge transport layer and a charge generating layer coated over a rigid conducting substrate support drum. However, for flexible electrophotographic imaging member belts, the charge transport layer and charge generating layer are coated on top of a flexible substrate support layer. To ensure that the imaging member belts exhibit sufficient flatness, an anticurl backing layer is coated onto the back side of the flexible substrate support layer to counteract upward curling and ensure imaging member flatness.

A typical flexible electrographic imaging member belt comprises a dielectric imaging layer on one side of the substrate support layer and an anticurl backing layer coated onto the opposite side of the substrate support layer to maintain imaging member flatness.

The top outermost layer, typically the charge transport layer of an electrophotographic imaging member or the dielectric imaging layer of an electrographic imaging member, is constantly subjected to mechanical and chemical actions with machine subsystems during imaging/cleaning processes. In order to mitigate erosion of the top outermost layer during these processes, the outermost layer can be coated with a thin protective overcoat to provide wear resistance and extend the imaging member's functional life. Although the present invention applies to both electrophotographic and electrographic imaging members, to simplify the following discussion, the discussion hereinafter will focus only on electrophotographic imaging members, particularly, imaging members in the flexible belt configuration.

In electrophotography, also known as Xerography, including electrophotographic imaging or electrostatic imaging processes, the surface of an electrophotographic imaging member (or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image. This electrostatic latent image can then be developed to form a visible image by depositing oppositely charged particles on the surface of the photoconductive insulating layer. The resulting visible image can then be transferred from the imaging member directly or indirectly (such as by a transfer or other member) to a print substrate, such as a transparency or paper. The image process can be repeated many times with reusable imaging members.

Flexible electrophotographic imaging members can be provided in a number of forms. For example, the imaging member can be a homogeneous layer of a single material, such as vitreous selenium, or it can be a composite layer containing a photoconductive layer and another material. In addition, the imaging member can be layered. Current layered organic imaging members generally have at least a flexible substrate support layer and two active layers. These active layers generally include (1) a charge generating layer containing a light absorbing material, and (2) a charge transport layer containing electron donor molecules. These layers can be in any order, and sometimes can be combined in a single or a mixed layer. The flexible substrate support layer can be formed of a conductive material. Alternatively, a conductive layer can be formed on top of a nonconductive flexible substrate support layer.

In many modem electrophotographic imaging systems the flexible photoreceptor belts are repeatedly cycled to achieve high speed imaging. As a result of this repetitive cycling, the outermost organic layer of the photoreceptor experiences a high degree of frictional contact with other machine subsystem components used to clean and/or prepare the photoreceptor for imaging during each cycle.

When repeatedly subjected to cyclic mechanical interactions against the machine subsystem components, photoreceptor belts can experience severe frictional wear at the outermost organic photoreceptor layer surface that can greatly reduce the useful life of the photoreceptor. For instance, in printers that employ a bias charging roller or a bias transfer roller (BCR or BTR), frictional wear can be so severe that the outer exposed layer's thickness can be reduced by as much as 10 microns per 100,000 photoreceptor belt revolutions. Ultimately, the resulting wear impairs photoreceptor performance to such a degree that the photoreceptor must be replaced. Replacement of the photoreceptor requires product downtime and costly maintenance.

Typically, manufacturers attempt to minimize frictional wear of the outermost organic layer by applying a protective overcoating to the outermost layer with various materials including nylon materials, such as a crosslinked Luckamide overcoat, so that the photoreceptor is mechanically robust enough to reach a desired product life goal. Unfortunately, although Luckamide and similar materials can provide sufficient protection against frictional wear, such overcoatings do not adhere well enough to the outermost layer of organic photoreceptors to sufficiently extend functional life to avoid the onset of premature overcoat delamination. For instance, although nylon overcoatings have been found to increase photoreceptor wear resistance and increase useful life by as much as four times, to achieve these advantages, it is necessary to heat the overcoat materials to an elevated temperature to bring about a cross-linking reaction to impart sufficient hardness and wear resistance. Although elevation of temperature to achieve total material cross-linking is needed to increase overcoat hardness and to enhance wear resistance, unfortunately, this cross-linking process also leads to poor adhesion between the overcoating and the top photoreceptor layer on which the overcoat is applied. As a result, the overcoating tends to prematurely delaminate, thereby negating the intended protective benefits of the overcoating.

Various methods are generally known in the art to improve adhesion between successive layers in a photoreceptor. For example, U.S. Pat. No. 5,919,514 discloses the use of plasma or corona discharge on an insulating member (substrate) of a donor roll, to increase adhesion and to provide a uniform subsequent metal coating. The disclosed process includes the step of applying corona discharge to the surface of the donor roll, prior to coating the donor roll substrate with a photo or thermally sensitive composition comprised of a polymeric material and a conductive metal nucleating agent.

Similarly, various methods such as plasma discharge and corona discharge are known and used for various purposes. For example, U.S. Pat. No. 5,635,327 discloses the use of glow discharge decomposition to apply amorphous silicon containing at least one of hydrogen and a halogen onto a conductive substrate. Likewise, U.S. Pat. No. 5,514,507 discloses using plasma discharge to form a layer having amorphous silicon germanium as a main body containing at least hydrogen, fluorine and a Group III element.

Another problem commonly associated with flexible photoreceptor belts during extended machine belt cycling is separation of the anticurl backing layer. Premature delamination of the anticurl backing layer from the photoreceptor belt substrate support layer, due to poor interfacial adhesion bond strength, can often reduce the belt's useful life by as much as 50%. Although various attempts to eliminate premature delamination have been successful, for example U.S. Pat. No. 5,013,624, such measures are generally highly complex and require innovative material reformulations.

Despite the above known methods for improving adhesion between photoreceptor layers, there remains a demand for methods directed to improving interfacial adhesion between a protective overcoating layer and the outermost layer of a photoreceptor onto which the overcoating layer is applied. Because of the above problems, there is an urgent need for effective methods of enhancing interfacial adhesion between overcoating materials and freshly coated outermost photoreceptor layers. There also remains a need for imaging members and photoreceptors having improved adhesion between an overcoating layer and an underlying layer, while still providing acceptable wear resistance to the imaging members and photoreceptors.

Furthermore, there is also a need for a simple innovative approach, for enhancing adhesive bond strength between an anticurl backing layer a substrate support layer, that can be easily adapted and implemented in photoreceptor belt manufacturing.

SUMMARY OF THE INVENTION

The present invention is directed to a process for preparing an organic electrophotographic imaging member, either in a flexible belt configuration or in a rigid drum configuration, having at least one charge generating layer and a charge transport layer, wherein the imaging member is added with an overcoating layer having increased interfacial adhesion bond strength between at least an outermost layer and the overcoating layer applied to the outermost layer. The process of the present invention comprises exposing the surface of the outermost organic layer of the imaging member to a corona effluent, and then immediately applying an overcoat layer to the treated outermost layer. Since the corona discharge effluent cleans as well as activates the outermost surface, it increases the outermost layer's surface energy to improve overcoat solution wetting and can thereby enhances chemical bonding to yield an increase in interfacial adhesion bond strength between the applied overcoating and the treated outermost layer.

In particular, the present invention provides a process for preparing an imaging member, comprising:

applying an organic layer to an imaging member substrate;

treating said organic layer with a corona effluent; and applying an overcoating layer to said organic layer.

The present invention also provides imaging members formed by such a process. Further, when applied to imaging members of the flexible belt configuration, the same corona effluent surface treatment process can be used to improve adhesion between an anticurl backing layer and an imaging member substrate support layer upon which the anticurl layer is applied.

It is, however, necessary to emphasize that the solvent or solvent mix system used to prepare the applied coating solution should not dissolve the imaging member layer over which the coating solution is applied so that effective adhesion enhancement can be achieved.

DETAILED DESCRIPTION OF PREFERRED EMBODIMENTS

Figure 1:
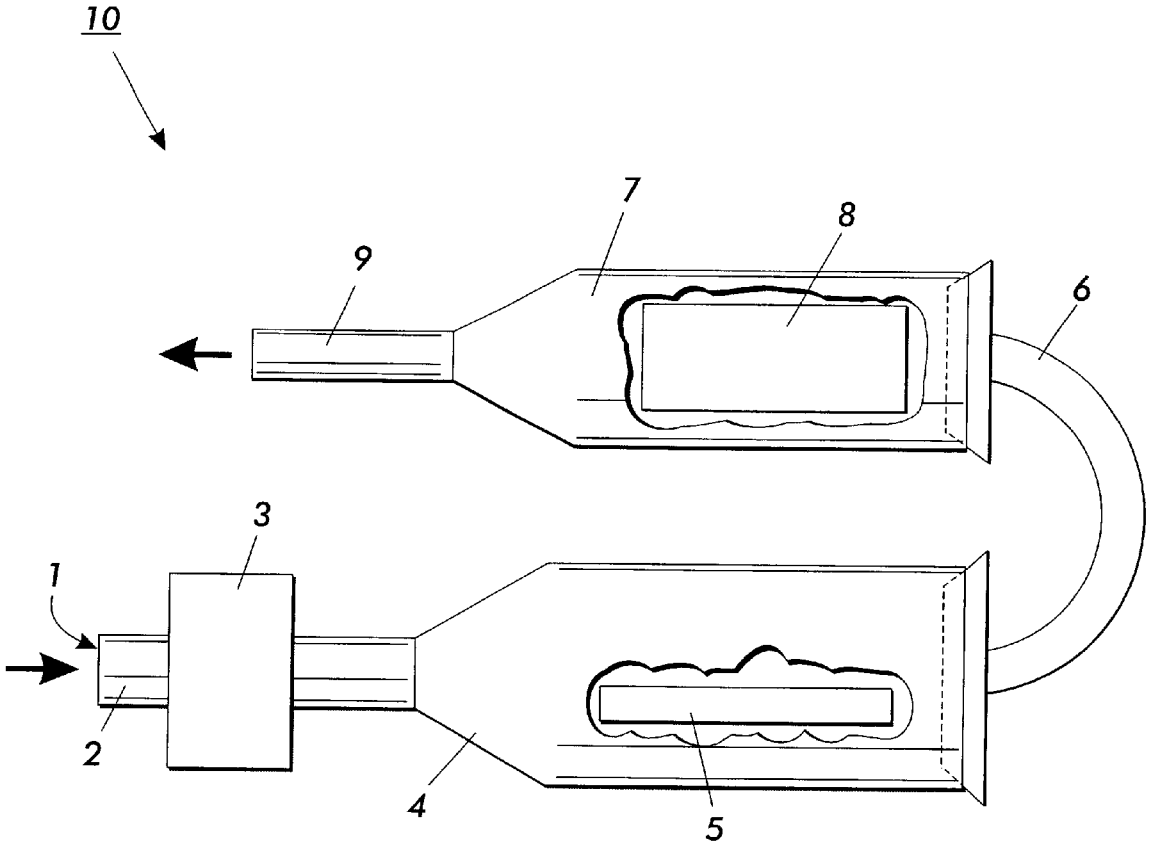
FIG. 1 is a schematic view of an exemplary embodiment of a treatment system according to this invention.

This invention is directed to a method for enhancing interfacial adhesion between an overcoating layer and an underlying layer of an organic photoreceptor by treating the underlying layer with a corona effluent prior to applying the overcoating layer, and an organic photoreceptor prepared by such a method. Further, the process of the present invention is equally applicable to flexible organic photoreceptor belts that comprise anticurl backing layers.

Although overcoating organic photoreceptors with nylon materials, such as a crosslinked Luckamide, is known to increase photoreceptor wear resistance and product life by as much as four times, the temperature elevation needed to initiate cross-linking process in order to achieve these advantages has been found to impair interfacial adhesion between the resulting overcoating and the underlying layer, such as the charge transport layer. Poor interfacial adhesion between the underlying layer and the applied overcoating layer leads to premature delamination of the overcoating, thereby minimizing the protective benefits of the overcoating. Moreover, premature anticurl backing layer delamination, often seen in flexible belt configured photoreceptors during cyclic machine function, is also an issue that remains to be resolved.

According to embodiments of the present invention, an electrophotographic imaging member is provided, that generally comprises at least a substrate layer, a charge generating layer, a charge transport layer, and an overcoating layer. The imaging member can be prepared by any of the various suitable techniques, provided that the outermost layer is treated by a corona effluent treatment method of the present invention, which will be described below, prior to applying the overcoating layer. As used herein, the term "outermost layer" refers to the outermost layer of the photoreceptor design prior to application of an overcoating layer. Thus, while the outermost layer is not the final, exposed layer of the completed photoreceptor, it is the outermost layer of the incomplete photoreceptor prior to application of a final overcoating layer. The "outermost layer" thus likewise can be referred to as an underlying layer of the overcoating layer.

According to the present invention, the outermost surface of the photoreceptor, commonly the charge transport layer, is treated by corona discharge effluent to prepare the surface of the outermost layer. Rather than treating the outermost surface of the photoreceptor directly with a corona discharge, embodiments of the present invention treat the outermost surface of the photoreceptor with a corona discharge effluent. Therefore, instead of roughening the surface of the outermost layer, as occurs during corona discharge treatment, embodiments of the present invention use corona discharge effluents to increase surface energy for enhancing coating solution wetting as well as providing chemical activation of the outermost layer's surface, through cleaning the surface, and, possibly, also creating active sites on the surface that can enhance chemical bonding to the applied crosslinked overcoating layer. By performing these functions, embodiments of the present invention can provide increased interfacial adhesion between the outermost layer and a subsequently applied overcoating layer. In embodiments, such treatment can avoid the use of a separate adhesive layer between the outermost layer and the overcoating layer. Preferably, the treatment step of the present invention is conducted inline, as a step in the production process, that permits fabrication of an imaging member with increased interfacial adhesion between the photoreceptor's outermost layer and overcoating layer.

Preferably, in embodiments of the invention, the corona effluent treatment only affects the outermost layer. That is, the treatment preferably physically and/or chemically alters only the outermost layer, such as by cleaning the surface of the layer to obtain an ultra clean outermost layer surface to promote overcoating solution wetting and intimate contact between the outermost layer and the applied overcoating layer. Moreover, such treatment can also enhance chemical bonding between the surface of the outermost layer and the applied overcoating layer so that the adhesion between the outermost layer and the overcoat are further enhanced.

According to the present invention, the specific parameters of the treatment step will generally depend upon, for example, the specific outermost layer materials to be treated, the amount of preparation desired, and/or the specific overcoating layer material to be applied.

A suitable method of treatment involves a corona discharge effluent. Corona discharge treatment is illustrated, for example, in U.S. Pat. No. 4,666,735, the entire disclosure of which is incorporated herein by reference. A corona discharge effluent can be applied to the surface of the outermost layer to be treated at any effective stage during the fabrication of the imaging member. For example, to yield best result, corona effluent treatment is preferably performed upon the surface of the outermost layer immediately before an overcoating layer is applied. In other embodiments, however, the surface treatment can be performed with a time interval between the surface treatment and the application of the overcoating layer. Thus, for example, the overcoating layer can be applied to the surface treated underlying layer immediately, or within between about 10 seconds and about 30 minutes after the surface treatment to give good result. In yet other embodiments, the overcoating layer can be applied to the surface treated underlying layer within about 1 or 2 hours, or 4 or 8 hours, or even 12 or 24 hours or more of the surface treatment to impart satisfactory outcome.

In addition, the process for improving adhesion between an anticurl backing layer and a substrate support layer of a flexible photoreceptor belt can be carried out in the exact same manner as described above.

Any suitable equipment can be used to treat the outermost surface with corona effluent, including but not limited to, Enercon Model A1 corona surface treatment device available from Enercon Industries Corporation.

According to the present invention, different parameters of the treatment can be necessary depending, for example, on the outermost layer material being treated. Thus, for example, the power setting, wattage, and the like of the equipment can be used to and adjusted to assess the degree of surface preparation, including but not limited to, surface cleanliness and surface energy. Adequate and acceptable processing parameters will be apparent to those skilled in the art based on the present disclosure, and/or can be readily determined through routine testing.

Accordingly, the corona discharge device should preferably operate at a power level and exposure duration sufficient to obtain the objects of the present invention. As an example only, a corona discharge device operating at a power level of about −5 kV in embodiments preferably has an exposure time of at least two minutes, and preferably from about 2 minutes to about 24 minutes or more, preferably from about 2 or 3 minutes to about 12 or 18 minutes. However, power levels and exposure times outside these values can be used as desired.

An exemplary embodiment of a treatment system according to the present invention is depicted in FIG. 1. In this embodiment of the treatment system 10, dry air is introduced through an opening 1 in a conduit 2. A flow meter 3 is placed in series between the opening 1 and a first vessel 4 to control the flow rate of dry air passing through the conduit 2 into the vessel 4. The vessel 4 contains a corona discharge device 5, and is connected via an adjoining conduit 6 to a second vessel 7. The second vessel 7 contains a photoreceptor 8 and a vent conduit 9. The corona discharge device 5 and the photoreceptor 8 are kept in separate vessels to insure that the photoreceptor 8 is only exposed to the effluent 11 of the corona device 5.

Although the vessels in the embodiment of FIG. 1 can be made of various materials and can be configured in various shapes, one suitable type of a vessel is a glass, tubular shaped vessel. In addition, while various corona devices can be used according to the present invention, one suitable corona device is an Enercon Model A1 corona surface treatment device available from Enercon Industries Corporation.

In operation, a method of treating a charge transport layer of an organic photoreceptor according to the present invention using the system of FIG. 1 involves several steps. First, a photoreceptor 8 to be treated is placed in the second vessel 7. Next, the corona device 5 is activated to produce a corona effluent 11. Dry air is then introduced through the conduit 2 into the first vessel 4. Although the dry air can be introduced into vessel 4 at various flow rates, dry air is preferably introduced at a flow rate that is greater than 155 $cm^3$/min, although any suitable flow rate can be used, as desired. The dry air transfers the corona effluent 11 from the first vessel through the connecting conduit 6 to the second vessel 7. The corona effluent 11 is then brought into contact with the outermost layer of the photoreceptor 8 causing surface energy of the outermost layer to be increased and causing the surface to be cleaned. Following the exposure of the photoreceptor to the corona effluent, the dry air and excess effluent is then vented from the second vessel 7 through the vent conduit 9.

The structure of an exemplary imaging member according to the claimed invention will now be described.

Typically, a flexible or rigid substrate is provided having an electrically conductive surface. A charge generating layer is then usually applied to the electrically conductive surface. An optional charge blocking layer can be applied to the electrically conductive substrate prior to the application of the charge generating layer. If desired, an adhesive layer can be used between the charge blocking layer and the charge generating layer. Usually, the charge generating layer is applied onto the blocking layer and a charge transport layer is formed on the charge generation layer (i.e. forming the outermost layer of the photoreceptor). However, in some embodiments, the charge transport layer can be applied prior to or concurrent with the charge generating layer, in which case the charge generating layer would constitute the outermost layer.

The substrate support layer can be opaque or substantially transparent and can comprise numerous suitable materials having the required mechanical properties as well as flexibility. Accordingly, the substrate support layer can comprise a layer of an electrically non-conductive or conductive material such as an inorganic or an organic composition. As electrically non-conducting materials, there can be employed various resins known for this purpose including, but not limited to, polyesters, polycarbonates, polyamides, polyurethanes, mixtures thereof, and the like. As electrically conductive materials there can be employed various resins that incorporate conductive particles, including but not limited to, resins containing an effective amount of carbon black, or metals such as copper, aluminum, nickel, alloys thereof, and the like. The substrate support layer can be either of a single layer design, or alternatively, can be of a multi-layer design that includes, for example, an electrically insulating layer having an electrically conductive layer applied thereon.

The electrically insulating or conductive substrate support layer is preferably in the form of a rigid cylinder, drum or belt. In the case of the substrate being in the form of a belt, the belt can be seamed or seamless, with a seamless belt being preferred.

The thickness of the substrate support layer depends on numerous factors, including desired strength and rigidity, as well as economic considerations. Thus, this layer can be of substantial thickness, for example, about 5,000 micrometers or more, or it can be of minimum thickness of less than or equal to about 150 micrometers, or anywhere in between, provided that there are no adverse effects on the final electrostatographic device. The surface of the substrate support layer is preferably cleaned prior to coating to promote greater adhesion of the deposited coating. Cleaning can be effected by any known process, including, for example, by exposing the surface of the substrate layer to plasma discharge, ion bombardment and the like.

The conductive layer can vary in thickness over substantially wide ranges depending on the optical transparency and degree of flexibility desired for the electrostatographic member. Accordingly, for a photoresponsive imaging device having an electrically insulating, transparent cylinder, the thickness of the conductive layer can be between about 10 angstrom units to about 500 angstrom units, and more preferably from about 100 angstrom units to about 200 angstrom units for an optimum combination of electrical conductivity and light transmission. The conductive layer can be an electrically conductive metal layer formed, for example, on the substrate by any suitable coating technique, such as a vacuum depositing technique. Typical metals include, but are not limited to, aluminum, zirconium, niobium, tantalum, vanadium and hafnium, titanium, nickel, stainless steel, chromium, tungsten, molybdenum, mixtures thereof, and the like. In general, a continuous metal film can be attained on a suitable substrate support layer, e.g. a polyester web substrate such as Mylar available from E.I. du Pont de Nemours & Co., with magnetron sputtering.

If desired, an alloy of suitable metals can be deposited. Typical metal alloys can contain two or more metals such as zirconium, niobium, tantalum, vanadium and hafnium, titanium, nickel, stainless steel, chromium, tungsten, molybdenum, and the like, and mixtures thereof. Regardless of the technique employed to form the metal layer, a thin layer of metal oxide generally forms on the outer surface of most metals upon exposure to air. Thus, when other layers overlying the metal layer are characterized as "contiguous" (or adjacent or adjoining) layers, it is intended that these overlying contiguous layers can, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers can be combinations of materials such as conductive indium tin oxide as a transparent layer for light having a wavelength between about 4000 Angstroms and about 7000 Angstroms or a conductive carbon black dispersed in a plastic binder as an opaque conductive layer. A typical surface electrical conductivity for conductive layers for electrophotographic imaging members in slow speed copiers is about $10^2$ to $10^3$ ohms/square.

After formation of an electrically conductive surface, a hole blocking layer can optionally be applied thereto for photoreceptors. Generally, electron blocking layers for positively charged photoreceptors allow holes from the imaging surface of the photoreceptor to migrate toward the conductive layer. For negatively charged photoreceptors, the blocking layer allows electrons to migrate toward the conducting layer. Any suitable blocking layer capable of forming an electronic barrier to holes between the adjacent photoconductive layer and the underlying conductive layer can be used. The blocking layer can include, but is not limited to, nitrogen containing siloxanes or nitrogen containing titanium compounds such as trimethoxysilyl propylene diamine, hydrolyzed trimethoxysilyl propyl ethylene diamine, N-beta(aminoethyl) gamma-amino-propyl trimethoxy silane, isopropyl 4-aminobenzene sulfonyl, di(dodecylbenzene sulfonyl)titanate, isopropyl di(4-aminobenzoyl)isostearoyl titanate, isopropyl tri(N-ethylaminoethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$ (gamma-aminobutyl)methyl diethoxysilane, $[H_2N(CH_2)_3]CH_3Si(OCH_3)_2$ (gamma-aminopropyl)methyl diethoxysilane, mixtures thereof, and the like, as disclosed in U.S. Pat. Nos. 4,291,110, 4,338,387, 4,286,033 and 4,291,110, the entire disclosures of which are incorporated herein by reference. A preferred blocking layer comprises a reaction product between a hydrolyzed silane and the oxidized surface of a metal ground plane layer. The oxidized surface inherently forms on the outer surface of most metal ground plane layers when exposed to air after deposition.

In a typical flexible photoreceptor belt, the blocking layer can be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. The blocking layers should be continuous and have a thickness of less than about 0.2 micrometer because greater thicknesses can lead to undesirably high residual voltage.

For rigid photoreceptor drum designs, the blocking layer is typically a continuous coating layer having a thickness of, for example, less than about 2 micrometers. The blocking layer can be formed of, for example, zirconium silane or Luckamide. A blocking layer having a greater thickness generally requires the addition of conducting molecules, for example $TiO_2$ doped phenolics, to avoid undesirably high residual voltage.

An optional adhesive layer can be applied to the hole blocking layer. Any suitable adhesive layer well known in the art can be used. Typical adhesive layer materials include, for example, but are not limited to, polyesters, dupont 49,000 (available from E.I. dupont de Nemours and Company), Vitel PE 100 (available from Goodyear Tire & Rubber), polyurethanes, and the like. Satisfactory results can be achieved with adhesive layer thickness between about 0.05 micrometer (500 angstrom) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating can be effected by any suitable conventional technique such as oven drying, infra red radiation drying, air drying and the like.

Any suitable photogenerating layer can be applied to the adhesive or blocking layer, which in turn can then be overcoated with a contiguous hole (charge) transport layer as described hereinafter.

Examples of typical photogenerating layers include, but are not limited to, inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from Dupont under the tradename Monastral Red, Monastral violet and Monastral Red Y, Vat orange 1 and Vat orange 3 trade names for dibromo anthanthrone pigments, benzimidazole perylene, perylene pigments as disclosed in U.S. Pat. No. 5,891,594, the entire disclosure of which is incorporated herein by reference, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Multi-photogenerating layer compositions can be used where a photoconductive layer enhances or reduces the properties of the photogenerating layer. Examples of this type of configuration are described in U.S. Pat. No. 4,415,639, the entire disclosure of which is incorporated herein by reference. Other suitable photogenerating materials known in the art can also be utilized, if desired.

Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and selenium tellurium alloys are also preferred because these materials provide the additional benefit of being sensitive to infra-red light.

Any suitable polymeric film forming binder material can be employed as the matrix in the photogenerating binder layer. Typical polymeric film forming materials include, but are not limited to, those described, for example, in U.S. Pat. No. 3,121,006, the entire disclosure of which is incorporated herein by reference. Thus, typical organic polymeric film forming binders include, but are not limited to, thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, arnino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly (amideimide), styrene-butadiene copolymers, vinylidenechloride-vinylchloride copolymers, vinylacetate-vinylidenechloride copolymers, styrene-alkyd resins, polyvinylcarbazole, mixtures thereof, and the like. These polymers can be block, random or alternating copolymers.

The photogenerating composition or pigment can be present in the resinous binder composition in various amounts. Generally, however, the photogenerating composition or pigment can be present in the resinous binder in an amount of from about 5 percent by volume to about 90 percent by volume of the photogenerating pigment dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is generally related to binder content. Thus, for example, higher binder content compositions generally require thicker layers for photogeneration. Of course, thickness outside these ranges can be selected providing the objectives of the present invention are achieved.

Any suitable and conventional technique can be used to mix and thereafter apply the photogenerating layer coating mixture. Typical application techniques include spraying, dip coating, roll coating, wire wound rod coating, and the like. Drying of the deposited coating can be effected by any suitable conventional technique such as oven drying, infra red radiation drying, air drying and the like.

The electrophotographic imaging member formed by the process of the present invention generally contains a charge transport layer in addition to the charge generating layer. The charge transport layer comprises any suitable organic polymer or non-polymeric material capable of transporting charge to selectively discharge the surface charge. Charge transporting layers can be formed by any conventional materials and methods, such as the materials and methods disclosed in U.S. Pat. No. 5,521,047 to Yuh et al., the entire disclosure of which is incorporated herein by reference. In addition, the charge transporting layers can be formed as an aromatic diamine dissolved or molecularly dispersed in an electrically inactive polystyrene film forming binder, such as disclosed in U.S. Pat. No. 5,709,974, the entire disclosure of which is incorporated herein by reference.

Any suitable and conventional technique can be used to mix and thereafter apply the charge transport layer coating mixture to the charge generating layer. Typical application techniques include spraying, dip coating, roll coating, wire wound rod coating, and the like. Preferably, the coating mixture of the transport layer comprises between about 9 percent and about 12 percent by weight binder, between about 27 percent and about 3 percent by weight charge transport material, and between about 64 percent and about 85 percent by weight solvent for dip coating applications. Drying of the deposited coating can be effected by any suitable conventional technique such as oven drying, infrared radiation drying, air drying and the like.

Generally, the thickness of the charge transport layer is between about 10 and about 50 micrometers, but thickness outside this range can also be used. The charge transport layer should preferably be an insulator to the extent that the electrostatic charge placed on the charge transport layer is not conducted in the absence of illumination at a rate sufficient to prevent formation and retention of an electrostatic latent image thereon. In general, the ratio of thickness of the charge transport layer to the charge generator layer is preferably maintained from about 2:1 to 200:1 and in some instances as great as 400:1. In other words, the charge transport layer is substantially non-absorbing to visible light or radiation in the region of intended use but is "active" in that it allows the injection of photogenerated holes from the photoconductive layer, i.e., charge generation layer, and allows these holes to be transported through the active charge transport layer to selectively discharge a surface charge on the surface of the active layer.

An overcoat layer is applied over the charge transport layer (or over the otherwise underlying outermost layer, for example where the charge transport layer and the charge generating layer are reversed or combined). However, according to the present invention, the underlying outermost layer is first surface treated, as described above, prior to application of the overcoating layer. The overcoat layer can comprise, for example, a dihydroxy arylamine dissolved or molecularly dispersed in a polyamide matrix. The overcoat layer can be formed from a coating composition comprising an alcohol soluble film forming polyamide and a dihydroxy arylamine.

In these embodiments, any suitable alcohol soluble polyamide film forming binder capable of forming hydrogen bonds with the hydroxy functional materials can be utilized in the overcoating. The expression "hydrogen bonding" is defined as the attractive force or bridge occurring between the polar hydroxy containing aryl-amine and a hydrogen bonding resin in which the hydrogen atom of the polar hydroxy arylamine is attracted to two unshared electrons of a resin containing polarizable groups. The hydrogen atom is the positive end of one polar molecule and forms a linkage with the electronegative end of the polar molecule. The polyamide used in the overcoatings should also have sufficient molecular weight to form a film upon removal of the solvent and also be soluble in alcohol. Generally, the weight average molecular weights of polyamides vary from about 5,000 to about 1,000,000. Since some polyamides absorb water from the ambient atmosphere, its electrical property can vary to some extent with changes in humidity in the absence of a polyhydroxy arylamine charge transporting monomer, the addition of charge transporting polyhydroxy arylamine minimizes these variations. The alcohol soluble polyamide should be capable of dissolving in an alcohol solvent, which also dissolves the hole transporting small molecule having multi hydroxy functional groups. The polyamide polymers required for the overcoatings are characterized by the presence of amide groups, —CONH. Typical polyamides include the various Elvamide resins, which are nylon multipolymer resins, such as alcohol soluble Elvamide and Elvamide TH Resins. Elvamide resins are available from E.I. Dupont Nemours and Company. Other examples of polyamides include Elvamide 8061, Elvamide 8064, and Elvamide 8023. One class of alcohol soluble polyamide polymer is disclosed in U.S. Pat. No. 5,709,974, the entire disclosure of which is incorporated herein by reference.

The polyamide should also be soluble in the alcohol solvents employed. Typical alcohols in which the polyamide is soluble include, for example, butanol, ethanol, methanol, and the like. Typical alcohol soluble polyamide polymers having methoxy methyl groups attached to the nitrogen atoms of amide groups in the polymer backbone prior to crosslinking include, for example, hole insulating alcohol soluble polyamide film forming polymers include, for example, Luckamide 5003 from Dai Nippon Ink, Nylon 8 with methylmethoxy pendant groups, CM4000 from Toray Industries, Ltd. and CM8000 from Toray Industries, Ltd., and other N-methoxymethylated polyamides, such as those prepared according to the method described in Sorenson and Campbell "Preparative Methods of Polymer Chemistry" second edition, pg 76, John Wiley & Sons Inc. 1968, and the like, and mixtures thereof. Other polyamides are Elvamides from E.I. Dupont de Nemours & Co. These polyamides can be alcohol soluble, for example, with polar functional groups, such as methoxy, ethoxy and hydroxy groups, pendant from the polymer backbone. These film forming polyamides are also soluble in a solvent to facilitate application by conventional coating techniques. Typical solvents include, for example, butanol, methanol, butyl acetate, ethanol, cyclohexanone, tetrahydrofuran, methyl ethyl ketone, and the like and mixtures thereof.

When the overcoat layer contains only polyamide binder material, the layer tends to absorb moisture from the ambient atmosphere and becomes soft and hazy. This adversely affects the electrical properties, and the sensitivity of the overcoated photoreceptor. To overcome this, the overcoating of this invention also includes a dihydroxy arylamine, as disclosed in U.S. Pat. Nos. 5,709,974, 4,871,634 and 4,588,666, the entire disclosures of which are incorporated herein by reference.

The concentration of the hydroxy arylamine in the overcoat can be between about 2 percent and about 50 percent by weight based on the total weight of the dried overcoat. Preferably, the concentration of the hydroxy arylamine in the overcoat layer is between about 10 percent by weight and about 50 percent by weight based on the total weight of the dried overcoat. When less than about 10 percent by weight of hydroxy arylamine is present in the overcoat, a residual voltage can develop with cycling resulting in background problems. If the amount of hydroxy arylamine in the overcoat exceeds about 50 percent by weight based on the total weight of the overcoating layer, crystallization can occur resulting in residual cycle-up. In addition, mechanical properties, abrasive wear properties are negatively impacted.

The thickness of the continuous overcoat layer selected can depend upon the abrasiveness of the charging (e.g., bias charging roll), cleaning (e.g., blade or web), development (e.g., brush), transfer (e.g., bias transfer roll), etc., system employed and can range up to about 10 micrometers. A thickness of between about 1 micrometer and about 5 micrometers in thickness is preferred. Any suitable and conventional technique can be used to mix and thereafter apply the overcoat layer coating mixture to the charge generating layer. Typical application techniques include spraying, dip coating, roll coating, wire wound rod coating, and the like. Drying of the deposited coating can be effected by any suitable conventional technique such as oven drying, infrared radiation drying, air drying and the like. The dried overcoating of this invention should transport holes during imaging and should not have too high a free carrier concentration. Free carrier concentration in the overcoat increases the dark decay. Preferably the dark decay of the overcoated layer should be the same as that of the unovercoated device.

The photoreceptors of the present invention can comprise, for example, a charge generator layer sandwiched between a conductive surface and a charge transport layer, as described above, or a charge transport layer sandwiched between a conductive surface and a charge generator layer. This structure can be imaged in the conventional xerographic manner, which usually includes charging, optical exposure and development.

Other layers can also be used, such as a conventional electrically conductive ground strip along one edge of the belt or drum in contact with the conductive layer, blocking layer, adhesive layer or charge generating layer to facilitate connection of the electrically conductive layer of the photoreceptor to ground or to an electrical bias. Ground strips are well known and usually comprise conductive particles dispersed in a film forming binder.

In some cases, such as flexible photoreceptor belts, an anti-curl back coating can be applied to the side opposite the photoreceptor substrate support layer to provide flatness and/or abrasion resistance. These overcoating and anti-curl back coating layers are well known in the art and can comprise thermoplastic organic polymers or inorganic polymers that are electrically insulating or slightly semiconductive. Overcoatings are continuous and generally have a thickness of less than about 10 micrometers.

Any suitable conventional electrophotographic charging, exposure, development, transfer, fixing and cleaning techniques can be used to form and develop electrostatic latent images on the imaging member of this invention. Thus, for example, conventional light lens or laser exposure systems can be used to form the electrostatic latent image. The resulting electrostatic latent image can be developed by suitable conventional development techniques such as magnetic brush, cascade, powder cloud, and the like.

The present invention enhances the interfacial adhesion between overcoat materials and the outermost (underlying) layer as well as the interfacial bond strength between the anticurl backing layer and the substrate support layer of an organic photoreceptor using the effluents of a corona discharge. More specifically, the present invention is directed to the use of effluents of a corona discharge to treat a surface of the outermost layer of an organic photoreceptor prior to the application and heat treatment of wear-resistant overcoat materials to achieve necessary adhesion while maintaining an overcoat's wear-resistant properties.

While the invention has been described in conjunction with the specific embodiments described above, it is evident that many alternatives, modifications and variations are apparent to those skilled in the art. Accordingly, the preferred embodiments of the invention as set forth above are intended to be illustrative and not limiting. Various changes can be made without departing from the spirit and scope of the invention.

The examples set forth hereinbelow and are illustrative of different compositions and conditions that can be used in practicing the invention. All proportions are by weight unless otherwise indicated. It will be apparent, however, that the invention can be practiced with many types of compositions and can have many different uses in accordance with the disclosure above and as pointed out hereinafter.

EXAMPLES

Example 1

An electrophotographic imaging member sheet is prepared. The imaging member includes a support substrate 6063 honed aluminum alloy 340 mm in length with a diameter of 30 mm. The first layer, an undercoat layer (UCL) used as an electrical and blocking layer, is applied, as like all other coatings are applied, by dip coating technology. A "three-component" UCL containing polyvinyl butyral (6 weight percent), zirconium acety acetonate (83 weight percent) and gamma-aminopropyl triethoxy silane (11 weight percent) are mixed, in the order listed, with n-butyl alcohol in 60:40 (by volume) solvent to solute weight ratio for the UCL. The UCL is applied in a thickness of approximately one micrometer to the honed substrate by dip coating. The substrate is next coated with about 0.2 micrometer thick charge generating layer (CGL) of hydroxygallium phthalocyanine (OHGaPC) and a terpolymer VMCH available from Union Carbide of: vinyl chloride (83 weight percent), vinyl acetate (16 weight percent) and maleic anhydride (1 weight percent), dissolved in n-butyl acetate (4.5 weight percent solids) in a 60:40 weight ratio (60 OHGaPC: 40 VMCH). The CGL is subsequently coated with a 24 micrometer thick (after drying) charge transport layer (CTL) of polycarbonate derived from bis phenyl Z (PCZ, available from Mitsubishi Chemicals) and N,N'-diphenyl-N,N'-bis(3-methylphenyl)-(1,1'-biphenyl)-4,4'diamine dissolved in tetrahydrofuran.

After drying the charge transport layer, the charge transport layer is exposed to corona discharge treatment effluent. The corona discharge is operated at −5 kV for an exposure time of three minutes.

Twenty-four hours after the corona discharge treatment, an overcoating layer is applied to the surface treated charge transport layer. The overcoating layer is coated using a solution of Luckamide® (a polyamide film forming polymer available from Dai Nippon Ink). The overcoating layer is dried at 110° C. for 30 minutes.

The thus prepared electrophotographic imaging member sheet is tested for adhesion of the overcoating layer to the underlying charge transport layer. The adhesion data is given in Table 1, below.

Examnples 2–4

Electrophotographic imaging member sheets are prepared as in Example 1 above, except that the corona discharge treatment time is set at 6, 12 or 24 minutes, respectively, for Examples 2, 3 and 4.

The thus prepared electrophotographic imaging member sheets are tested for adhesion of the overcoating layer to the underlying charge transport layer. The adhesion data is given in Table 1, below.

Comparative Example 1

An electrophotographic imaging member sheet is prepared as in Example 1 above, except that the corona discharge treatment is not performed on the charge transport layer.

The thus prepared electrophotographic imaging member sheet is tested for adhesion of the overcoating layer to the underlying charge transport layer. The adhesion data is given in Table 1, below.

TABLE 1

| Example | Corona Treatment Time (min) | Adhesion (g/cm) | | |
|---|---|---|---|---|
| 1 | 3 | 76 | 58 | CNP* |
| 2 | 6 | CNP | CNP | CNP |
| 3 | 12 | CNP | | |
| 4 | 24 | CNP | CNP | |
| Comp 1 | None | 4.1 | 8.5 | 3.1 |

*CNP = Cannot Peal

Examples 5–9

Electrophotographic imaging member sheets are prepared as in Example 1 above, except that the corona discharge treatment time is varied, and the overcoating layer is applied to the surface treated charge transport layer immediately after the surface treatment is completed. The corona discharge treatment times for the Examples are set forth in Table 2 below.

The thus prepared electrophotographic imaging member sheets are tested for adhesion of the overcoating layer to the underlying charge transport layer. The adhesion data is given in Table 2, below.

Comparative Example 2

An electrophotographic imaging member sheet is prepared as in Examples 5–9 above, except that the corona discharge treatment is not performed on the charge transport layer.

The thus prepared electrophotographic imaging member sheet is tested for adhesion of the overcoating layer to the underlying charge transport layer. The adhesion data is given in Table 2, below.

TABLE 2

| Example | Corona Treatment Time (min) | Adhesion (g/cm) | | | |
|---|---|---|---|---|---|
| 5 | 0.25 | 0 | 0.3 | | |
| 6 | 0.5 | 1.1 | 0.8 | 0.5 | |
| 7 | 1 | 10 | 14 | 16 | |
| 8 | 2 | CNP | CNP | CNP | 5 |
| 9 | 4 | CNP | CNP | CNP | CNP |
| Comp 2 | 0 | 0 | 0.3 | | |

*CNP = Cannot Peal

Comparative Example 3

An electrophotographic imaging member web is prepared by providing a 0.02 micrometer thick titanium layer coated on a PET polyester substrate support layer (Melinex 442, available from ICI Americas, Inc.) having a thickness of 3 mils (76.2 micrometers) and applying thereto, using a ½ mil gap Bird applicator, a solution containing 10 grams gamma aminopropyltriethoxy silane, 10.1 grams distilled water, 3 grams acetic acid, 684.8 grams of 200 proof denatured alcohol and 200 grams heptane. This layer is allowed to dry for 5 minutes at 135° C. in a forced air oven. The resulting blocking layer has an average dry thickness of 0.05 micrometer measured with an ellipsometer.

An adhesive interface layer is prepared by applying with a ½ mil gap Bird applicator to the blocking layer a wet coating containing 5 percent by weight based on the total weight of the solution of polyester adhesive (Mor-Ester 49,000, available from Morton International, Inc.) in a 70:30 volume ratio mixture of tetrahydrofuran/cyclohexanone. The adhesive interface layer is allowed to dry for 5 minutes at 135° C. in a forced air oven. The resulting adhesive interface layer has a dry thickness of 0.065 micrometer.

The adhesive interface layer is thereafter coated with a photogenerating layer containing 7.5 percent by volume trigonal selenium, 25 percent by volume N,N'-diphenyl-N,N'-bis(3-methylphenyl)-1,1'-biphenyl-4,4'-diamine, and 67.5 percent by volume polyvinylcarbazole. This photogenerating layer is prepared by introducing 8 grams polyvinyl carbazole and 140 mls of a 1: 1 volume ratio of a mixture of tetrahydrofuran and toluene into a 20 oz. amber bottle. To this solution is added 8 grams of trigonal selenium and 1,000 grams of ⅛ inch (3.2 millimeter) diameter stainless steel shot. This mixture is placed on a ball mill for 72 to 96 hours. Subsequently, 50 grams of polyvinyl carbazole and 2.0 grams of N,N'-diphenyl-N,N'-bis(3-methylphenyl)-1,1'-biphenyl-4,4'-diamine are dissolved in 75 ml of 1:1 volume ratio of tetrahydrofuran/toluene. This slurry is placed on a shaker for 10 minutes. The resulting slurry is thereafter applied to the adhesive interface layer by using a ½ mil gap Bird applicator to form a coating layer having a wet thickness of 0.5 mil (1 2.7 micrometers). However, a strip about 10 mm wide along one edge of the substrate bearing the blocking layer and the adhesive layer is deliberately left uncoated by any of the photogenerating layer material to facilitate adequate electrical contact by the ground strip layer that is applied later. This photogenerating layer is dried at 135° C. for 5 minutes in a forced air oven to form a dry photogenerating layer having a thickness of 2.0 micrometers.

This coated imaging member web is simultaneously overcoated with a charge transport layer and a ground strip layer using a 3 mil gap Bird applicator. The charge transport layer is prepared by introducing into an amber glass bottle a weight ratio of 1:1 N,N'-diphenyl-N,N'-bis(3-methylphenyl)-1,1 '-biphenyl-4-4'-diamine and Makrolon 5705, a polycarbonate resin having a molecular weight of from about 50,000 to 100,000 commercially available from Farbenfabriken Bayer A.G. The resulting mixture is dissolved to give a 15 percent by weight solid in 85 percent by weight methylene chloride. This solution is applied onto the photogenerator layer to form a coating which upon drying has a thickness of 24 micrometers.

The approximately 10 mm wide strip of the adhesive layer left uncoated by the photogenerator layer is coated with a ground strip layer. This ground strip layer, after drying at 135° C. in a forced air oven for 5 minutes, has a dried thickness of about 14 micrometers. This ground strip is electrically grounded, by conventional means such as a carbon brush contact device during a conventional xerographic imaging process.

An anticurl backing layer coating solution is prepared by combining 8.82 grams of polycarbonate resin of 4,4'-isopropylidene diphenol (Makrolon 5705, having a molecular weight of about 120,000 and available from Bayer AG), 0.092 gram of copolyester resin (Vitel PE-100, available from Goodyear Tire and Rubber Company) and 90.1 grams of methylene chloride in a glass container to form a coating solution containing 8.9 percent solids. The container is covered tightly and placed on a roll mill for about 24 hours until the polycarbonate and polyester are dissolved in the methylene chloride to form the anti-curl coating solution. The anticurl backing layer coating solution is applied to the rear surface (side opposite the photogenerator layer and charge transport layer) of the imaging member web with a 3 mil gap Bird applicator and dried at 135° C. for about 5 minutes in a forced air oven to produce a dried film thickness of about 13.5 micrometers and containing approximately 1 weight percent Vital PE-100 adhesion promoter, based on the total weight of the dried anticurl backing layer. The resulting electrophotographic imaging member had a structure similar to that schematically shown in FIG. 1 and was used to serve as an imaging member control.

Example 10

An electrophotographic imaging member web is prepared according to the procedures and using the same materials as those described in Comparative Example 3, with the exception that the backside of the PET polyester substrate support layer is exposed to corona effluents emitted from a Corotron charging device, to clean and activate the surface of the substrate support layer, prior to the application of the anticurl backing layer coating. The power supplied to the charging device is about 6 kv and the transport speed of the charging device traversing over the substrate support layer surface is about 5 inches per second.

Example 11

The electrophotographic imaging member webs of Comparative Example 3 and Example 10 are evaluated for anticurl backing layer adhesion to the substrate support layer by 180° peel strength measurement. The peel strengths obtained for the anticurl backing layer of each of these imaging member webs are assessed for comparison.

The procedures for 180° peel strengths measurement are carried out by cutting a minimum of three 0.5 inch (1.2 cm.)×6 inches (15.24 cm) imaging member samples from each of Comparative Examples 3 and Example 10. For each sample, the anticurl backing layer is partially stripped from the test sample with the aid of a razor blade and then hand peeled to about 3.5 inches from one end to expose the substrate support layer inside the sample. This stripped sample is then secured to a 1 inch (2.54 cm)×6 inches (15.24 cm) and 0.05 inch (0.254 cm) thick aluminum backing plate (having the charge transport layer facing the backing plate) with the aid of two sided adhesive tape. The end of the resulting assembly, opposite the end from which the anticurl backing layer is not stripped, is inserted into the upper jaw of an Instron Tensile Tester. The free end of the partially peeled anticurl backing layer is inserted into the lower jaw of the Instron Tensile Tester. The jaws are then activated at a one inch/mm crosshead speed, a two inch chart speed and a load range of 200 grams, to peel the sample at least two inches at an angle of 180°. The load recorded is then calculated to give the peel strength of the test sample. The peel strength is determined to be the load required for stripping the anticurl backing layer off from the substrate support layer divided by the width (1.27 cm) of the test sample.

The results obtained for 180° peel strength between the anticurl backing layer (ACBL) and the substrate support layer (PET), and wear resistance are listed in Table 3 below:

TABLE 3

| Example | Corona Treatment on PET | Peel Strength ACBL/PET (gms/cm) |
|---|---|---|
| Comp. 3 | None | 8.4 |
| 10 | Yes | 29.3 |

The data listed in the table above show that the peel strength of the anticurl backing layer of the invention imaging member of Example 10 is substantially increased. The peel strength increase from 8.4 gms/cm for the test sample of Comparative Example 3 to high of 29.3 gms/cm for the test sample of Example 10 represents a 3.5 times anticurl backing layer adhesion improvement through the simple corona effluent exposure on the back surface of the imaging member substrate support layer moments before the application of anticurl backing layer coating solution. It is important to point out that the solvent (methylene chloride) used for the anticurl backing layer costing solution preparation is not a solvent that could dissolve the PET.

What is claimed is:

1. A process for preparing an electrostatographic imaging member, the process comprising:

a. applying an organic layer to an imaging member substrate;

b. placing the imaging member substrate, on which the organic layer has been applied, in a first container;

c. generating a corona effluent by ionizing air with a corona discharge device that is in a second container;

d. transferng said corona effluent from the corona discharge device to the organic layer to surface treat the organic layer by directing a flow of air through the second container, thereby transferring said corona effluent from the second container to the first container; and e. applying an overcoating layer to said surface-treated organic layer to form said electrostatographic imaging member.

2. The process of claim 1, wherein said organic layer is a charge transport layer.

3. The process of claim 1, wherein said organic layer is a charge generation layer.

4. The process of claim 1, wherein said substrate is a flexible supporting layer.

5. The process of claim 1, wherein said substrate is a rigid drum.

6. The process of claim 1, wherein transferring said corona effluent from the corona discharge device to the organic layer to surface treat the organic layer increases surface energy and coating solution wettability of said organic layer.

7. The process of claim 1, wherein said process provides increased interfacial adhesion between said organic layer and said overcoating layer as compared to a similar structure made without said treating step.

8. The process of claim 1, wherein transferring said corona effluent from the corona discharge device to the organic layer to surface treat the organic layer cleans a surface of said organic layer.

9. The process of claim 1, wherein said process cleans said organic layer to provide an ultra clean surface to promote intimate contact between said organic layer and said overcoating layer.

10. The process of claim 1, wherein said process increases surface energy of the organic layer to enhance interfacial adhesion between said organic layer and said overcoating.

11. The process of claim 1, wherein a solvent or solvent mix used for applying the overcoating layer is selected so that the overcoating layer does not dissolve the surface-treated organic layer over which the overcoating layer is applied.

12. The process of claim 1 further comprising:

f. treating a backside of said substrate with a corona effluent; and g. applying an anticurl backing layer to the treated backside of said substrate.

13. The process of claim 12, wherein a solvent or solvent mix used for the anticurl backing layer is selected so that it does not dissolve the substrate over which the anticurl backing layer is applied.

14. The process of claim 1, wherein the imaging member is only exposed to the corona effluent of the corona discharge device.

15. A process for enhancing adhesion of an overcoat layer to an organic layer of a photoreceptor, the process comprising:

a. placing the photoreceptor in a first container;

b. generating a corona effluent by ionizing air with a corona discharge device that is in a second container;

c. transferring said corona effluent from the corona discharge device to the organic layer to surface treat the organic layer by directing a flow of air through the second container so that said corona effluent is transferred from the second container to the first container;

d. exposing said organic layer of the photoreceptor to said corona effluent for a duration of time prior to applying said overcoat layer to said organic layer; and e. applying the overcoat layer to the surface of said organic layer.

16. The process of claim 15, wherein air is directed through the first container at a flow rate greater than about 155 $cm^3$/min.

17. The process of claim 15, wherein said corona device is operated at about −5 kV.

18. The process of claim 15, wherein said organic surface is exposed to said corona effluent for at least about 2 minutes.

19. The process of claim 15, wherein the photoreceptor is only exposed to the corona effluent of the corona discharge device.

20. The process of claim 15, wherein a solvent or solvent mix used for applying the overcoat layer is selected so that the overcoat layer does not dissolve the surface-treated organic layer over which the overcoat layer is applied.

21. A process for enhancing adhesion of an anticurl backing layer to a backside of a flexible substrate supporting layer of a photoreceptor belt comprising:

a. placing the photoreceptor belt in a first container;

b. generating a corona effluent by ionizing air with a corona discharge device that is in a second container;

c. transferring said corona effluent from the corona discharge device to the backside of the flexible supporting layer to surface treat said backside by directing a flow of air through the second container so that said corona effluent is transferred from the second container to the first container;

d. exposing said backside of said flexible supporting layer to said corona effluent for a duration of time prior to applying said anticurl backing layer to said supporting layer; and e. applying the anticurl backing layer to the treated backside of the flexible supporting layer.

22. The process of claim 21, wherein air is directed through the first container at a flow rate greater than about 155 cm3/min.

23. The process of claim 21, wherein said corona device is operated at about −5 kV.

24. The process of claim 21, wherein said backside is exposed to said corona effluent for at least about 10 seconds.

25. The process of claim 21, wherein the photoreceptor belt is only exposed to the corona effluent of the corona discharge device.

26. The process of claim 21, wherein a solvent or solvent mix used for the anticurl backing layer is selected so that it does not dissolve the substrate support layer over which the anticurl backing layer is applied.

* * * * *